United States Patent [19]

Taylor

[11] Patent Number: 4,974,416

[45] Date of Patent: Dec. 4, 1990

[54] LOW COKE FUEL INJECTOR FOR A GAS TURBINE ENGINE

[75] Inventor: Jack R. Taylor, Cincinnati, Ohio

[73] Assignee: General Electric Company, Cincinnati, Ohio

[21] Appl. No.: 316,558

[22] Filed: Feb. 27, 1989

Related U.S. Application Data

[63] Continuation of Ser. No. 42,929, Apr. 27, 1989, abandoned.

[51] Int. Cl.[5] ..... F23R 3/32

[52] U.S. Cl. ..... 60/737; 60/743; 60/748; 239/404

[58] Field of Search ..... 60/734, 737, 740, 743, 60/744, 748; 239/400, 404, 405, 468, 492

[56] References Cited

U.S. PATENT DOCUMENTS

| | | | |
|---|---|---|---|
| 3,530,667 | 9/1970 | Bryan | 60/743 |
| 3,667,221 | 6/1972 | Taylor | 60/743 |
| 3,703,259 | 11/1972 | Sturgess et al. | 60/743 |
| 3,808,803 | 5/1974 | Salvi | 60/737 |
| 3,811,278 | 5/1974 | Taylor et al. | 60/737 |
| 3,899,884 | 8/1975 | Ekstedt | 60/737 |
| 3,937,011 | 2/1976 | Carvel et al. | 60/748 |
| 3,946,552 | 3/1976 | Weinstein et al. | 60/743 |
| 3,972,182 | 8/1976 | Salvi | 60/743 |

FOREIGN PATENT DOCUMENTS

| | | | |
|---|---|---|---|
| 2169695 | 7/1986 | United Kingdom | 60/748 |

*Primary Examiner*—Louis J. Casaregola
*Assistant Examiner*—Timothy S. Thorpe
*Attorney, Agent, or Firm*—Jerome C. Squillaro

[57] ABSTRACT

A carbureting device for the combustor of a gas turbine comprises an annular spin chamber which is defined by a generally annular housing having a closed forward end, an exhaust tube which is partially disposed within the spin chamber, and a flange disposed around the exhaust tube. A swirling air entrance is disposed between the annular housing and the flange and a fuel entrance is disposed along the annular housing spaced axially forward of the swirling air entrance. In one embodiment of the invention the exhaust tube is a venturi. In another embodiment a fairing is disposed outside and aft of the spin chamber and is sized and disposed about and extending at least to the end of the venturi, thereby forming a passageway between the fairing and the venturi. A second air swirling means is disposed in the passageway formed by the fairing and the venturi.

27 Claims, 1 Drawing Sheet

LOW COKE FUEL INJECTOR FOR A GAS TURBINE ENGINE

This is a continuation of application Ser. No. 042,929, filed Apr. 27, 1987, now abandoned.

BACKGROUND OF THE INVENTION

This invention relates generally to carbureting devices for gas turbine engines and, more particularly, to gas turbine engine systems having low pressure fuel injectors commonly referred to as fuel cups.

Gas turbine engines generally comprise a compressor for pressurizing air and a combustor for burning the fuel with a portion of the pressurized air and heating the remaining pressurized air or a large portion thereof which is then flowed into a turbine to generate power. Fuel that is burned is normally premixed with air prior to undergoing combustion in order to minimize smoke and other undesirable by-products and maximize the efficiency of the combustion process. The carbureting device is designed to atomize the fuel, and premix it with air in order to effect efficient and complete combustion. A very common problem is coking, a phenomenon which is a build up of carbon caused by unburnt fuel being heated at nonstoichiometric conditions on hot surfaces. This deposition of carbon leads to a build up or coking which clogs passageways and seriously degrades the engine's operation.

Spray atomizing nozzles have been used in the past with varying degrees of success for the prevention of coking which in turn blocks nozzle passages and leads to inefficient combustion and expensive repairs. Efficient spray atomizers may also require high pressure systems which add weight and cost to fuel supply systems, a consequence which gas turbine engine designers are constantly seeking to avoid.

Low pressure fuel systems have been designed which incorporate primary and secondary counterrotational air swirlers which atomize fuel by the high shear forces developed in the area or zone of interaction between the two counterrotational flows. Such designs require thin fuel injectors that are prone to coking or require complicated and expensive air systems to prevent coking. Yet other suggested low pressure fuel injectors mix air and fuel upstream of the air swirlers, such as in U.S. Pat. Nos. 3,667,221 and 3,811,278, before injecting the air and fuel mixture into a spin chamber. These schemes also experience coking in the areas containing the swirling vanes and on the vanes as well.

OBJECTS OF THE INVENTION

It is a primary object of the present invention to provide an improved gas turbine engine carbureting device which premixes fuel and air for introduction into the combustion chamber for efficient, low emission and low smoke combustion of the fuel.

Another object of the present invention is a carbureting device which prevents coking of the fuel and air passageways.

Yet another object of the present invention is to provide uniform fuel distribution in such a device.

A further object of this invention is to provide fine atomization of the fuel in such a device.

One other object of this invention is a simple easy to manufacture carbureting device.

One further object of the invention is a carbureting device which allows ease of installation and removal of a fuel tube feeding such a device.

SUMMARY OF THE INVENTION

A gas turbine carbureting device comprises a spin chamber defined by a generally annular wall having a closed forward end and a closed aft end attached to each opening of said annular wall. The aft end has at least one aperture and an exhaust means disposed therethrough, and said wall includes a fuel entrance and a swirling air entrance axially spaced apart. In one embodiment of the invention the exhaust means is a verturi. In another embodiment a secondary air swirler is disposed circumferentially about the venturi outside of the spin chamber within a fairing and is used to enhance the carbureting process. Another embodiment of the invention includes a tangential fuel injection means which may be a straight tube and in a more particular form have a flared entrance. In yet another embodiment the aft end is generally cup-shaped including a dimple.

BRIEF DESCRIPTION OF THE DRAWING

The invention together with further objects and advantages thereof, is more particularly described in the following detailed description taken in conjunction with the accompanying drawing, in which.

DESCRIPTION OF THE PREFERRED EMBODIMENT

Figure 1:
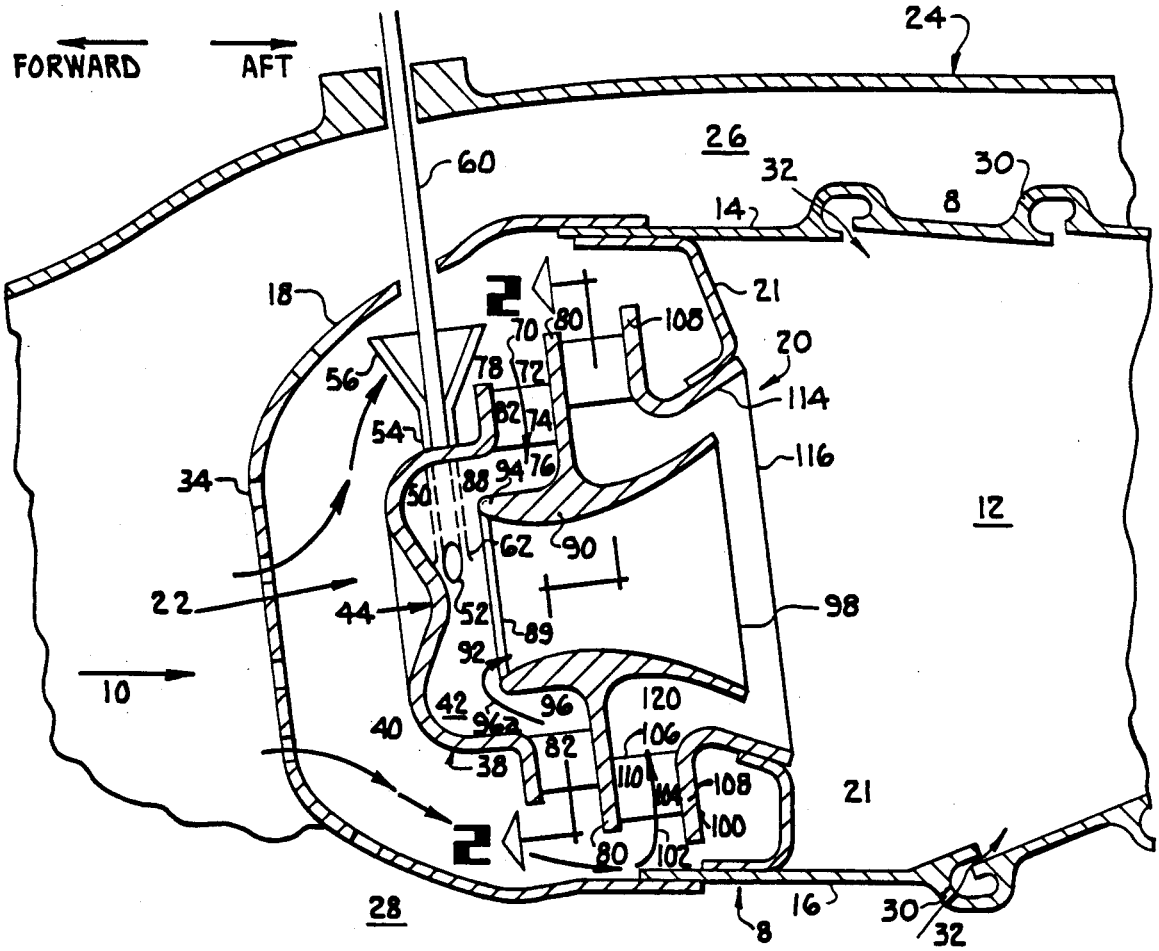
FIG. 1 is a sectional view of an exemplary combustor of a gas turbine engine including a carbureting device according to one form of the invention.

Referring to the drawings and particularly to FIG. 1, the invention is shown disposed in a gas turbine engine combustor 8 which is downstream of the compressor (not shown) and in fluid communication with compressor discharge air 10. Combustor 8 circumscribes a combustion chamber 12 therein. The combustor 8 is generally annular in form and is comprised of an outer liner 14 an inner liner 16 and a generally dome-shaped end 18. A combustor bulkhead 21 attached to the outer and inner liners 14 and 16 respectively includes a plurality of circumferentially spaced openings 20, each having disposed therein an improved carbureting device 22 according to one form of the present invention for the delivery of a fuel and air mixture into the combustion chamber.

The combustor 8 is enclosed by a casing 24 which together with the outer liner 14 and the inner liner 16 define an annular outer passage 26 and an inner passage 28 respectively. The outer liner 14 and the inner liner 16 have a first plurality of apertures 30 to deliver a first portion of air 32 to the combustion chamber 12. The combustor end 18 includes a second plurality of apertures 34 to supply compressor discharge air 10 to the carbureting device 22. The carbureting device 22 comprises a spin chamber 42 defined by a generally annular housing 38 having a cup-shaped closed forward end 40 having a continuous unobstructed inner surface 43. The forward end 40 may, as in the preferred embodiment, have a dimple 44 which protrudes into the spin chamber 42 and is smoothly faired into the housing 38. A fuel port 52 and a first swirling air port 72 are disposed in said housing wherein the swirling air entrance 72 is axially aft of the fuel port 52.

Figure 2:
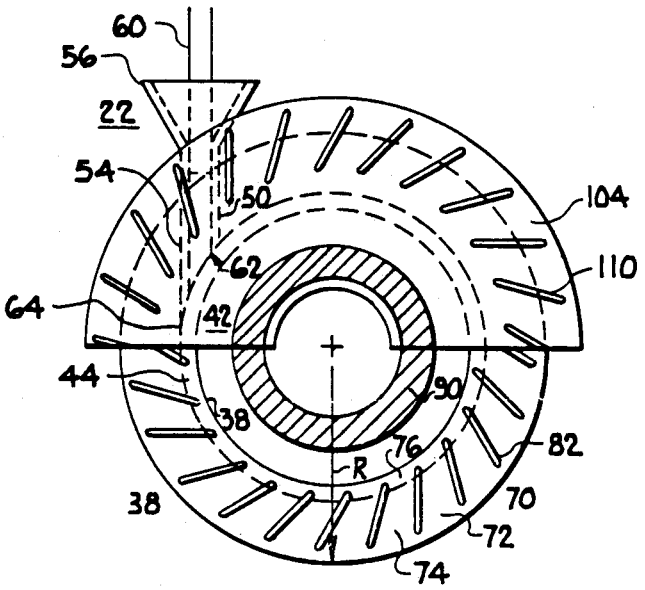
FIG. 2 is a cross-sectional view thereof taken along the 2—2 of FIG. 1.

A tangential fuel injector 50, which in this embodiment is a straight tube 54, having an exit 62 at fuel injection port 52 and tangential to the curvature of the annular housing 38. The fuel injection tube 54 includes a flared entrance 56 adapted to securely mate with a low pressure fuel line 60. A primary air swirler 70 is located at the aft end of spin chamber 42 and in the preferred embodiment is integral therewith. Said primary air swirler comprises a primary air inlet 72 adapted to receive compressor discharge air 10, an annular primary air passage 74, a primary air exit 76 to spin chamber 42. The primary air passage 74 is defined by a first flange 78 attached to the aft end of housing 38 and a second flange 80 spaced apart therefrom. A plurality of primary swirling vanes 82 are circumferentially disposed between said first and second flanges, preferably equidistant from each other. As can be seen in FIG. 2 the primary vanes 82 are angled with respect to the radius 84 of the first and second flanges 78 and 80 and are oriented so that the air is swirled in the same tangential direction as the fuel is injected into the spin chamber 42.

An exhaust tube 90 is disposed within the second flange 80 so that flange 80 serves as a bulkhead for spin chamber 42 and positions exhaust tube 90. The primary swirling vanes 82 connects the first and second flanges and the second flange 80 supports the exhaust tube 90. In the preferred embodiment exhaust tube 90 is shaped as a venturi and is conventional in the art will be referred to as venturi 90. Venturi 90 is sufficiently spaced apart from and positioned with respect to housing 38 so as to form a flow reversal means 96 which is designed to cause the swirling air to axially reverse its flow and follow the path as shown by arrow 96*a* in FIG. 1. A part of the flow reversal means 96 is bounded by the outer wall of the venturi 90 which together with housing 38 form an annular air passage 88 to introduce the swirling air into a the bottom of the spin chamber. Venturi 90 has a venturi entrance 92 spaced sufficiently forward of the primary air exit 76 so as to force the primary swirling air to flow forward and then turn around an edge 94 of wall 96 and flow aft. Edge 94 is aerodynamically shaped to minimize turning losses of the flow. A venturi exit 98 opens up to combustion chamber 12.

A secondary air swirler 100 is circumferentially disposed about and radially spaced apart from said venturi 90. The secondary air swirler 100 comprises a secondary air inlet 102 adapted to receive compressor discharge air 10, a secondary annular air passage 104, and a secondary air exit 106. The secondary annular air passage 104 is defined by the second flange 80 and a third flange 108 which is spaced axially aft of the second flange and coaxial with said first and second flanges. A plurality of secondary swirling vanes 110 are disposed between said second and third flanges 80 and 108 respectively, preferably equidistant from each other. As can be seen in FIG. 2 the secondary vanes 110 are angled with respect to the radius R and may be angled in the same direction or an opposite to that of the primary swirler vanes 82. Referring again to FIG. 1, a bell-mouth shaped exhaust or fairing 114 is attached to the third flange 108 and extends aft of the venturi exit 98. Fairing 114 is positioned and spaced so as to form a fluid passageway 120 for secondary swirling air entering through the secondary air swirler.

In operation, compressor discharge air 10 is delivered to the carbureting device 22, commonly referred to as a fuel cup, through openings 20 in the dome-shaped end 18 of combustor 8. As can be seen in FIG. 2, low pressure fuel is delivered to the tangential fuel injector 50 by a fuel supply line 60. The fuel injection tube 54 has a flared entrance 56 to facilitate the installation and removal of the fuel supply line 60. The tangential fuel injector 50 is a straight tube mounted tangentially with respect to the annular housing 38 which injects the fuel in a swirling direction within the spin chamber 42. The swirling direction of the fuel causes the fuel to form a spinning film along the inside of the housing 38. The primary air swirler 70 receives compressor discharge air 10 and swirls it, preferably in the same direction as the fuel. The primary swirling vanes 82 are judiciously angled with respect to radius R of housing 38 to maximize the air swirling effect.

Referring again to FIG. 1, the swirling air is conducted into the spin chamber 42 through the annular passages 74 past the fuel injection port 52 thereby helping to conduct the fuel into the spin chamber 42. The viscous interaction between of air flow and fuel enhances the spinning of the fuel and formation of a fuel film in the spin chamber 42. The combined swirling velocity and reversal of the air flow produce a fine fuel film on the surface of the cup-shaped forward end 40 of the housing 38 and a radially inner fuel ring on the forward end. The swirling ring of fuel occurs because of the counteracting centrifugal force, associated with the swirling or spinning motion, and the viscous forces of the air axially flowing out through the exhaust tube or venturi 90 acting on the fuel. At the edge of the ring tiny droplets of fuel form and are liberated from the fuel ring, travel down the venturi 90 where it further mixes with the air and is then expelled through the venturi exit 98 into the combustion chamber 12.

The secondary air swirler 100 is adapted to receive compressor discharge air 10 and swirl it into a fluid passageway 120 which enhances the flow through the venturi 90 for carbureting purposes in several ways. It creates a low pressure area by cyclonic action which enhances the flow and creates more shearing force flows that further atomize the fuel in the air and fuel mixture through the venturi. If the secondary swirling vanes 110 are angled in a direction opposite to that of the primary swirling vanes 82 then additional shearing forces will be created forward of the venturi 98 which will enhance the atomization of the fuel prior to combustion.

From the above discussion it can be understood that the fuel and air mixture does not have a chance to coke within the carbureting device's small passages such as between the primary swirling vanes.

It will be clear to those skilled in the art that the present invention is not limited to the specific embodiments described and illustrated herein. Nor is the invention limited to carbureting devices in gas turbine engines. The embodiment discussed above is for application in an annular combustor but the invention can also be applied to a coannular or can type of combustor.

It will be understood that the relative dimensions and proportional and structural relationships shown in the drawings are illustrated by way of example only and those illustrations are not to be taken as the actual dimensions or proportional structural relationships used in the construction of the present invention.

Numerous modifications, variations, and full and partial equivalents can be undertaken without departing from the invention as limited only by the spirit and scope of the appended claims.

What is desired to be secured by Letters Patent of the United States is the following.

I claim:

1. A gas turbine carbureting device for disposal in a downstream flowing compressor discharge air flow comprising:

a spin chamber defined by a generally annular housing including a closed forward end having a continuous unobstructed inner surface and an open aft end wherein said forward end is upstream of said aft end with respect to the compressor discharge airflow;

at least one exhaust tube having an inlet disposed within said spin chamber wherein said exhaust tube is radially spaced apart from said annular housing and which together with said annular housing forms at least in part a first annular air passage leading to said forward end;

said housing having a fuel entrance and a swirling air entrance to said first annular air passage and spaced axially apart from each other, and wherein said swirling air entrance and fuel entrance are downstream of said closed forward end with respect to the compressor discharge flow; and wherein said first air passage is formed for flowing swirling air from said swirling air passage to said aft end in an upstream direction with respect to the compressor discharge flow and said exhaust tube inlet is disposed within said swirl chamber so as to reverse the axial direction of the swirling air off said forward end from an upstream direction to a downstream direction through said exhaust tube.

2. The device of claim 1 wherein said fuel entrance is spaced axially forward of said swirling air entrance.

3. The device of claim 2 wherein said exhaust tube is a venturi.

4. The device of claim 2 further comprising a secondary air swirler in fluid and pressure communication with said exhaust tube.

5. The device of claim 3 wherein said exhaust tube is a venturi.

6. The device of claim 4 wherein said fuel injector means is in fluid communication with said fuel entrance and effective for injecting fuel into said spin chamber in a direction tangential to said annular housing.

7. The device of claim 5 wherein said forward end includes a dimple which protrudes into said spin chamber.

8. The device of claim 7 wherein said fuel injector means comprises a straight pipe having a flared entrance.

9. A gas turbine carbureting device for supplying an air and fuel mixture to a combustion chamber, comprising:

a spin chamber defined by a generally cup-shaped housing closed at its forward end and open at its aft end and having a first flange attached to said aft end;

an exhaust tube having an outlet and an inlet wherein said inlet is disposed within said spin chamber;

wherein said exhaust tube is disposed radially inward of said first flange to form an annular fluid duct between said housing and said exhaust tube, said fluid duct having a swirling air entance;

a second flange attached to and disposed about said exhaust tube between said inlet and outlet and spaced aft of said first flange forming a first radial passage between said first and second flanges in fluid communication with said swirling air entrance;

an air swirling means disposed between said first and second flanges; and a fuel injection means having at least one fuel entrance, and wherein said swirling air entrance and fuel entrance are aft of said closed forward end in said spin chamber housing located axially forward of said swirling air entrance.

10. The device of claim 9 wherein said air swirling means comprises a plurality of air swirling vanes.

11. The device of claim 10 wherein said exhaust tube is a venturi.

12. The device of claim 11 wherein said fuel injector is a tangential fuel injector which injects fuel tangential to said annular housing.

13. The device of claim 12 wherein said forward end includes a dimple which protrudes into said spin chamber.

14. The device of claim 13 wherein said fuel injector includes a pipe having a flared entrance.

15. The device of claim 14 wherein said fuel injector is a straight pipe.

16. The device of claim 9 further comprising:

a fairing including a third flange attached to said fairing wherein said fairing is circumferentially disposed about said exhaust tube and said third flange is spaced aft of said second chamber forming an air conduit in fluid communication with the combustion chamber, a secondary air swirling means disposed between said second and third flanges.

17. The device of claim 16 wherein said secondary air swirling means comprises a second plurality of air swirling vanes.

18. The device of claim 17 wherein said fuel injector is a tangential fuel injector.

19. The device of claim 18 wherein said exhaust tube is a venturi.

20. The device of claim 19 wherein said forward end includes a dimple which protrudes into said spin chamber.

21. The device of claim 16 wherein said exhaust tube is a venturi.

22. The device of claim 21 wherein said forward end includes a dimple which protrudes into said spin chamber.

23. The device of claim 22 wherein said fuel injector is a tangential fuel injector which injects fuel tangential to said annular housing.

24. The device of claim 23 wherein said fuel injector includes a flared entrance.

25. The device of claim 24 wherein said fuel injector is a straight pipe.

26. The device of claim 21 wherein said second plurality of air swirling vanes are angled so as to swirl the air in the same tangential as the fuel is injected.

27. The device of claim 26 wherein said first and second pluralities of air swirling vanes are angled in opposite directions.

* * * * *